United States Patent [19]

Wiehler

[11] 4,270,069

[45] May 26, 1981

[54] TRAVELING WAVE TUBE AND METHOD OF MAKING SAME

[75] Inventor: Wolf Wiehler, Neubiberg, Fed. Rep. of Germany

[73] Assignee: Siemens Aktiengesellschaft, Berlin & Munich, Fed. Rep. of Germany

[21] Appl. No.: 60,373

[22] Filed: Jul. 25, 1979

[30] Foreign Application Priority Data

Aug. 3, 1978 [DE] Fed. Rep. of Germany ..... 2834135

[51] Int. Cl.[3] ..... H01J 25/34

[52] U.S. Cl. ..... 315/3.5; 29/25.11; 29/25.13; 29/600; 315/3.6; 315/39.3

[58] Field of Search ..... 315/3.5, 3,6, 39.3; 29/600, 25.11, 25.13, 25.15

[56] References Cited

U.S. PATENT DOCUMENTS

| | | | |
|---|---|---|---|
| 3,271,614 | 9/1966 | Scott | 315/3.5 |
| 3,271,615 | 9/1966 | Washburn, Jr. | 315/3.5 |
| 3,293,478 | 12/1966 | Winkler | 315/3.5 |
| 3,374,388 | 3/1968 | Huber | 315/3.5 |
| 3,408,529 | 10/1968 | Solomon | 315/3.5 |
| 3,435,273 | 3/1969 | Kennedy | 315/3.5 |
| 3,548,345 | 12/1970 | Falce | 315/3.5 |
| 3,634,723 | 1/1972 | Gross | 315/3.5 |
| 3,748,729 | 7/1973 | Bottcher et al. | 315/3.5 |

*Primary Examiner*—Saxfield Chatmon, Jr.

*Attorney, Agent, or Firm*—Hill, Van Santen, Steadman, Chiara & Simpson

[57] ABSTRACT

A traveling wave tube has a delay line in the form of a spiral conductor supported within a metallic vacuum shell by a plurality of dielectric support rods. The support rods are covered at least partially with a metalization and soldered together with the delay line and the vacuum shell is shrunk onto the support rods, thus providing a simple structure having good heat dissipating properties.

9 Claims, 2 Drawing Figures

TRAVELING WAVE TUBE AND METHOD OF MAKING SAME

BACKGROUND OF THE INVENTION

1. Field of the Invention

The present invention relates to a traveling wave tube and more particularly to a traveling wave tube having a delay line in the form of a spiral or ring ribbon conductor, arranged between an electron beam generating system and an electron beam collector within a sturdy metallic vacuum shell.

2. The Prior Art

Traveling wave tubes incorporating spiral-shaped delay lines supported within a sturdy metallic vacuum shell by a number of dielectric support rods are known from the German AS No. 1,937,704, which corresponds to the Gross et al U.S. Pat. No. 3,634,723. The apparatus illustrated therein incorporates a number of dielectric support rods arranged parallel to one another, which support rods are fixed in their lateral position by means of the shape of the interior cross section of the vacuum shell, with good thermal contact between the support rods and the shell. Such traveling wave tubes have a flexible support mounting of the spiral system for assisting in attaining a good heat dissipation from the spiral to the vacuum shell. It is also known from the Gross et al patent to allow the vacuum shell, when it is constructed of glass, to expand through heating and thereafter to shrink onto the support rods so that its interior cross section assumes longitudinal grooves which support the longitudinal support rods. The Gross et al patent also describes that the spiral may be soldered together with the support rods and the rods are in turn soldered to the vacuum shell for the purpose of rendering the spiral insensitive to vibration. When this is attempted during manufacture, however, it becomes clear that a complicated manufacturing arrangement is required, and also, the completed construction can suffer cracks in either the solder joints or the ceramic support rods, due to thermal expansion. As a result, the previously known design is not suitable for construction of traveling wave tubes with relatively small dimensions, or with relatively high power capacities which require the dissipation of considerable quantities of heat.

BRIEF DESCRIPTION OF THE INVENTION

It is a principal object of the present invention to provide a traveling wave tube construction with relatively small dimensions which is suitable for high-frequency operation, with superior heat dissipation characteristics.

To this end, the present invention consists in designing the heat dissipation from the delay line in as optimum a fashion as possible. It has been found that the heat dissipation of the traveling wave tube of the type referred to above can be materially improved if the support rods are at least partially provided with a metalization, and they are soldered together with the delay line, with the vacuum shell shrunken onto the support rods. It has also been found preferable to form the support rods of beryllium oxide.

In one embodiment of the present invention, there is provided a traveling wave tube having a spiral delay line supported within a metallic vacuum shell by a plurality of support rods, the support rods being provided with a metalization at the contact locations with the delay line, which metalization consists of superposed layers of copper and gold. The traveling wave tube is constructed by inserting the delay line with its supporting rods into the vacuum shell, and the vacuum shell is inserted into a thick-walled metal tube. Subsequently, the support rods are soldered together with the delay line and the vacuum shell is simultaneously shrunken onto the support rods.

The present invention provides a significant advantage in the improvement of the heat dissipation, which results from the combined soldering and shrinking technique. Such soldering and shrinking can take place during a single manufacturing operation, which greatly facilitates the manufacture of the traveling wave tubes.

When the soldering and shrinking are combined in a single operation, the precise position of the support rods is automatically provided by the vacuum shell. Such an arrangement does not result when shrinking takes place after soldering is complete, because the shearing as the result of shrinking tend to tear apart the solder joints.

BRIEF DESCRIPTION OF THE DRAWINGS

Reference will now be made to the accompanying drawings in which.

DESCRIPTION OF THE PREFERRED EMBODIMENTS

Figure 2:
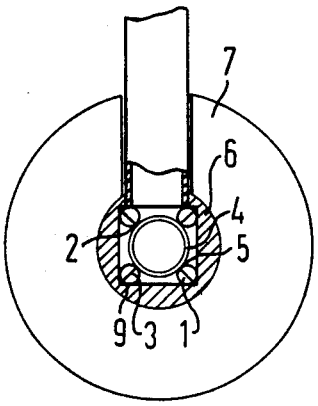
FIG. 2 is a cross sectional view of the apparatus of FIG. 1 along the line II—II.
Figure 1:
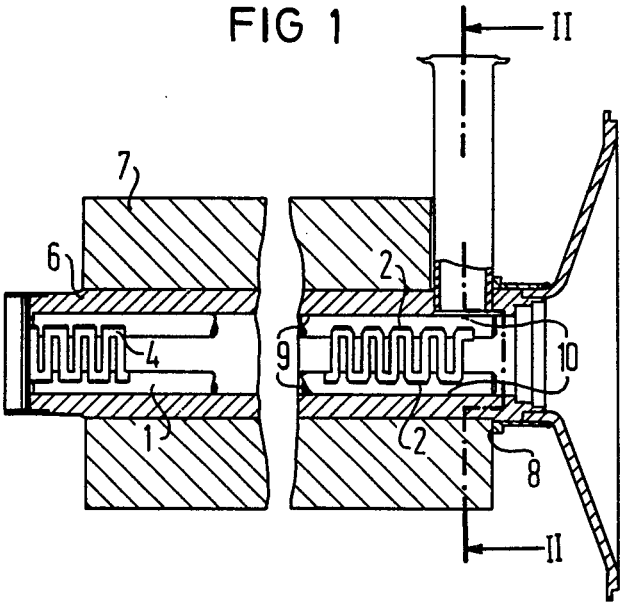
FIG. 1 is a longitudinal cross sectional view of the traveling wave tube constructed in accordance with an illustrative embodiment of the present invention, in simplified form.

Referring now to the drawings, a traveling wave tube is illustrated in which a delay line 4 is mounted within a sturdy metallic vacuum shell 6. A plurality of support rods 1, preferably consisting of BeO, are provided with a punctiform metalization at the places where they contact the delay line 4. Such metalization may take place by means of the Mo-Mn method, or another known method. The metalization points which result in this fashion are subsequently coated with a thin layer of copper and then the copper layer is overlain with a gold layer. The copper and gold layers are preferably applied by known electroplating techniques, resulting in a layer thickness of 3 to 5 μm. Alternatively, the gold layer may be applied first, and then the copper layer.

To facilitate handling of the apparatus, the support rods 1 are provided at their frontal faces with an orientation line 3, which is applied to the rods with the metal coating operation, and indicates the alignment of the metalization applied to the rods.

The delay line 4 is preferably formed of tungsten or molybdenum, and is coated with an electroplated coating of copper or gold with a layer thickness of 3 to 5 μm. When the support rods are soldered to the delay line, either a gold layer is juxtaposed between two copper layers, or a copper layer is juxtaposed between two gold layers. The soldering may take place by either of two different soldering operations. One soldering operation uses a temperature of 550° to 750° C., with pressure applied between the members being soldered, resulting in a diffusion soldering. Alternatively, when a temperature of approximately 950° C. is used, a fuse soldering can be effected through the gold-copper alloy which is formed at that temperature. The fuse soldering has the advantage of improved heat dissipation, since a more effective thermal conduction cross section is formed. Either soldering method may be employed, depending on the particular service requirements of the traveling wave tube.

Simultaneously with the soldering operation, the shrinking of the vacuum shell 6 occurs. The vacuum shell 6 is preferably formed of copper and has an interior cross section which is either triangular or square, depending on whether a three-rod or four-rod system is utilized. A four-rod system is illustrated in FIG. 2, so that a square inner cross section of the vacuum shell 6 is employed. The dimensions of the side wall of this inner profile are 0.05–0.1 mm greater than the dimensions of the delay line-support rod unit, so that a ready insertion and subsequent precise alignment of the support rods 1 and the delay line 4 is possible. After alignment, the support rods 1 and the delay line 4 are held in fixed position by means of tungsten spring clips (not shown). The final assembly is then inserted into a thick-walled metal tube 7, which closely fits around the exterior of the vacuum shell 6, and which is preferably formed of molybdenum. A limit stop 8 in the form of a ring surrounding the shell 6 determines the relative position of the shell 6 and the tube 7 when assembled. The construction is then heated to a temperature of 700° through 950° C., depending on the desired soldering method, in a protective gas or vacuum soldering furnace and, because of the expansion difference between the molybdenum and the copper, there results a pressing of the copper vacuum shell 6 onto the assembly consisting of the delay line 4 and the support rods 1. The outward expansion of the copper is obstructed by the sturdy molybdenum tube 7, and is therefore deformed interiorally during the heating process, the ductility of the copper preventing a bursting of the molybdenum tube 7. After cooling, the copper tube shrinks onto the support rods 1, corresponding to the expansion differences.

In one embodiment, where the copper vacuum shell had an interior diameter of 15 mm, a shrinking of this dimension of approximately 0.1 mm resulted during the heating and shrinking process. The process of the present invention yields very great pressures between the vacuum shell 6, the support rods 1 and the delay line 4, so that a very good heat transmission results through the places where these members contact each other, even at places where they are not soldered together.

In the traveling wave tube produced in accordance with the present invention, the delay line 4 acts as an interior spring element, since it is compressed inwardly by the support rods 1, and the outward force against the support rods 1 produced by the compressed delay line always insures a good contact pressure during the entire life of the traveling wave tube.

The points 5 of the delay line 4 which touch the support rods 1 are soldered to the support rods simultaneously with the shrinking operation. When the soldering operation is desired to be a diffusion soldering, it is desirable to hold the temperature of the assembly at approximately 600° C. for approximately ten minutes, in order to prolong the time period of the diffusion process which takes place as a result of the temperature and pressure.

The soldering of the support rods 1 to the vacuum shell 6 is relatively difficult, because of the differences in expansion between the BeO and copper of which these parts are formed. Over the entire length of the delay line 4, the expansion differences may amount to as much as 1 mm. Therefore, when expansions of that order are expected, it is advantageous to solder the support rods 1 to the vacuum shell 6 only at the location of the highest temperature load, namely at the end 10 of the delay line 4. For this purpose, the support rods 1 are metal-coated, as well as copper-plated and gold-plated, only at the locations for which soldering is desired. Even though the remainder of the support rods 1 are not soldered to the vacuum shell, the intimate physical contact between them resulting from the manner of formation of the traveling tube of the present invention insures a good heat-conducting relationship.

It will be apparent that others skilled in the art may make additions and modifications in the present invention without departing from the essential features of novelty thereof, which are intended to be defined and secured by the appended claims.

What is claimed is:

1. A method of making a traveling wave tube having a copper vacuum shell, a delay line in the form of a spiral or ring ribbon conductor formed of tungsten or molybdenum arranged between an electron generating system and an electron beam collector, and a plurality of dielectric support rods running parallel to the delay line and interposed between said delay line and the vacuum shell, comprising the steps of; providing a metalization on said support rods at locations which contact said delay line, assembling said delay line, said support rods and said vacuum shell, placing the assembly within a thick-walled metal tube and heating said assembly to soldering temperature, whereby said support rods and said delay line are soldered together and said vacuum shell is simultaneously shrunk onto said support rods.

2. The method according to claim 1, wherein said metalization step consists of providing successive layers of copper and gold on said support rods and including the step of coating said ring ribbon conductor with copper and wherein said thick-walled metal tube is formed of molybdenum and said heating step comprises heating the assembly to a temperature of between 700° and 950° C.

3. The method of claim 1, wherein said copper shell is deformed interiorally during said heating step.

4. The method according to claim 1, wherein said metalization is a punctiform metalization.

5. The method according to claim 1, including the step of applying said metalization to the ends of said support rods.

6. The method according to claim 1, including the step of forming said support rods of beryllium oxide.

7. The method according to claim 1, including the step of forming said vacuum shell of copper.

8. The method according to claim 1, wherein said delay line is provided with an electroplated layer of copper.

9. The method according to claim 1, wherein said thick-walled metal tube is formed of molybdenum.

* * * * *